US007178969B1

(12) United States Patent
Shiang et al.

(10) Patent No.: US 7,178,969 B1
(45) Date of Patent: Feb. 20, 2007

(54) MOGUL LAMP HOLDER

(75) Inventors: William Shiang, St. Louis, MO (US); Richard Ursch, St. Louis, MO (US); Wendell Dodson, St. Louis, MO (US)

(73) Assignee: Interglobal Inc., St. Louis, MO (US)

( * ) Notice: Subject to any disclaimer, the term of this patent is extended or adjusted under 35 U.S.C. 154(b) by 0 days.

(21) Appl. No.: 11/205,853

(22) Filed: Aug. 17, 2005

(51) Int. Cl.
*H01R 33/00* (2006.01)

(52) U.S. Cl. ..... 362/650; 439/188; 439/615; 439/650; 439/667

(58) Field of Classification Search ..... 439/615, 439/667, 642; 362/650
See application file for complete search history.

(56) References Cited

U.S. PATENT DOCUMENTS 5,698,935 A 12/1997 Newman
5,853,299 A * 12/1998 Wu ..... 439/419
5,874,800 A 2/1999 Newman
5,951,313 A * 9/1999 Arimoto ..... 439/188
6,457,845 B1 * 10/2002 Collins et al. ..... 362/311
2006/0019544 A1 * 1/2006 Tufano et al. ..... 439/642

* cited by examiner

*Primary Examiner*—Renee Luebke
*Assistant Examiner*—Mary Zettl
(74) *Attorney, Agent, or Firm*—Renner, Otto, Boisselle and Sklar, LLP

(57) ABSTRACT

A lamp holder is disclosed lamp holder that will accept and make electrical contact with a lamp having a predetermined base and will accept, but not make electrical contact with lamps having other bases. A cavity (or central well) in the base (or floor) of the lamp socket is provided to accept a lamp configured with an extension extending from the base of the lamp and providing a vertically mounted electrical contact in the cavity that can only be contacted by a lamp contact that is placed at the end of the lamp base extension. A lamp lacking such an extension and a contact on such extension, cannot extend into and engage the contact in the cavity.

13 Claims, 4 Drawing Sheets

MOGUL LAMP HOLDER

The present invention pertains generally to a lamp holder for receiving lamps and more particularly to a family of lamp holders capable of accepting lamps having a predetermined base structure.

BACKGROUND OF THE INVENTION

Metal halide lamps generally include a relatively centrally located arc tube situated within the confines of an outer glass bulb. These arc tubes are conventionally made of quartz and operate at extremely high temperatures and relatively high pressures. Under certain undesirable conditions, a system failure or internal factors will result in a safety hazard being created, whereby a violent shattering of the arc tube will send hot glass and lamp particles into contact with the bulb glass which, in turn, will break, releasing the hot glass and lamp particles into the surrounding environment. Under such conditions, there is an obvious risk of severe personal injury, fire and/or property damage.

For these reasons, conventional metal halide lamps are generally supported within "enclosed" fixtures whose structure is designed to contain violently released hot glass and lamps particles. In addition, significant reductions in such potential violent failures can be achieved by replacing the lamp before the rated end of the life for the lamp. Another conventional manner for reducing the risk in which such potential violent failures includes the user's periodically turning off the lamp to permit its cooling, so that upon relighting, a non-violent or less violent lamp failure is facilitated.

As disclosed in U.S. Pat. Nos. 5,698,935 and 5,874,800, manufacturers of metal halide lamps are selling lamps for use in what are referred to as "open" fixtures. In open fixtures, the lamp is mounted such that it is exposed during its use. In order to reduce or eliminate the risks associated with violent lamp failures in non-enclosed environments, metal halide lamps may include a relatively thick shroud of quartz situated intermediate the arc tube and the outer bulb glass such that, in the event of a violent lamp failure of the type described above, the shroud is capable of containing the hot glass and lamp particles, which would otherwise impact and possibly break the bulb glass. One result is a less expensive and equally safe lamp and fixture combination suitable for indoor commercial lighting applications such as offices and retail spaces, as well as other environments.

However, to prevent the use of lamps intended to be used in an "enclosed" fixture in an "open" fixture, the newer "shrouded" lamp is provided with a different type of base so that the lamps intended for an "open" fixture can be rapidly identified and separated from lamps that must be used in an "enclosed" fixture.

Prior art lamp holders generally utilize a metal sleeve and a cantilever mounted contact to supply power to the lamp, as detailed in U.S. Pat. Nos. 5,698,935 and 5,874,800. There are many problems associated with a cantilever mounted contact and lamp interface. For example, the center contact spring may be easily displaced during the re-lamp process, the center contact spring may be displaced or dislodged if the center contact becomes bent during the re-lamping process. A cantilever mounted contact may allow a user to tamper with the center contact. For example, the cantilever mounted center contact may be bent to extend to a point above the bulb security well (or hub) so that an "enclosed" fixture bulb can be used in a lamp holder designed for an "open" fixture mental halide bulb.

Thus, there is a strong need for a lamp holder (or lamp socket) that overcomes the deficiencies of the prior art.

SUMMARY OF THE INVENTION

The present invention relates to a lamp holder including: a lamp socket body of insulating material having an open first end, a closed second end and a sidewall, wherein the open first end, the closed second and the sidewall form a first cavity; a conductive sleeve disposed within at least a portion of the first cavity, wherein the conductive sleeve includes a top portion, a central portion and a bottom portion, wherein at least one portion of the conductive sleeve is at least partially threaded for receiving an associated lamp and the conductive sleeve is adapted to be connected to one side of an AC voltage supply; a second cavity formed by a hub in the lamp socket body adjacent the closed second end and communicating with said first cavity to receive an extension of an associated lamp; a vertically mounted contact, the contact having a first end secured to the lamp socket body and a second, free end extending substantially vertically from the first end and into the second cavity to engage a central button contact of an associated lamp, wherein the contact is adapted to be connected to a second side of said AC voltage supply; a recess in the interior of said second closed end communicating with said cavity; and a spring having a first end and a second end, said first end in said recess and the second end engaging the second, free end of said contact to urge said contact second end into intimate contact with the central button contact of an associated lamp in said cavity.

Another aspect of the invention relates to a lamp holder including: a lamp socket body of insulating material having an open first end, a closed second end and a sidewall, wherein the open first end, the closed second and the sidewall form a first cavity; a conductive sleeve disposed within at least a portion of the first cavity, wherein the conductive sleeve includes a top portion, a central portion and a bottom portion, wherein at least one portion of the conductive sleeve is at least partially threaded for receiving an associated lamp and the conductive sleeve is adapted to be connected to one side of an AC voltage supply; a second cavity formed by a hub in the lamp socket body adjacent the closed second end and communicating with said first cavity to receive an extension of an associated lamp; a vertically mounted contact, the contact having a first end formed in the lamp socket body and a second, free end extending substantially vertically from the first end and into the second cavity to engage a central button contact of an associated lamp, wherein the contact is adapted to be connected to a second side of said AC voltage supply; a recess in the interior of said second closed end communicating with said cavity; and a spring having a first end and a second end, said first end in said recess and the second end engaging the second, free end of said contact to urge said contact second end into intimate contact with the central button contact of an associated lamp in said cavity.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Likewise, elements and features depicted in one drawing may be combined with elements and features depicted in additional drawings. Moreover, in the drawings, like reference numerals designate corresponding parts throughout the several views.

DETAILED DESCRIPTION OF THE INVENTION

Figure 1:
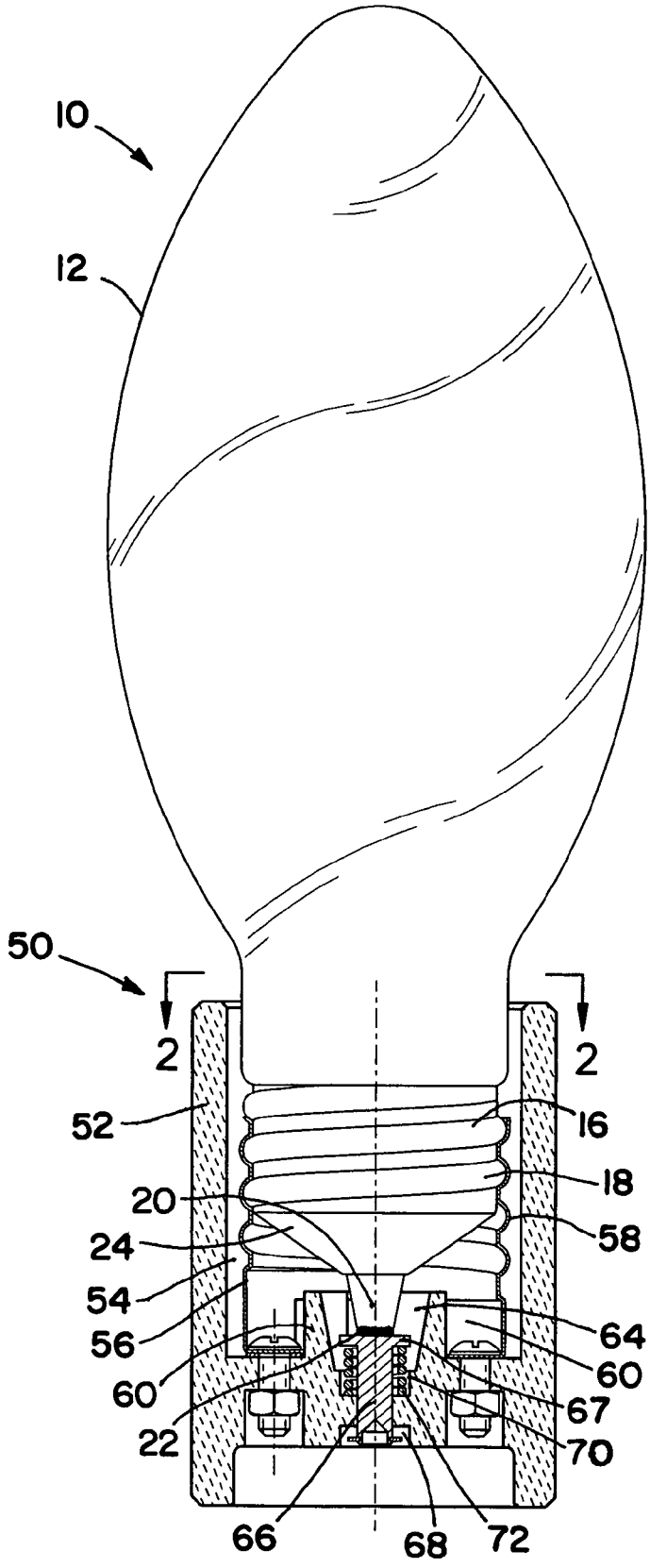
FIG. 1 is a cross-sectional view of a lamp holder in accordance with one aspect of the invention and an associated lamp.
Figure 2:
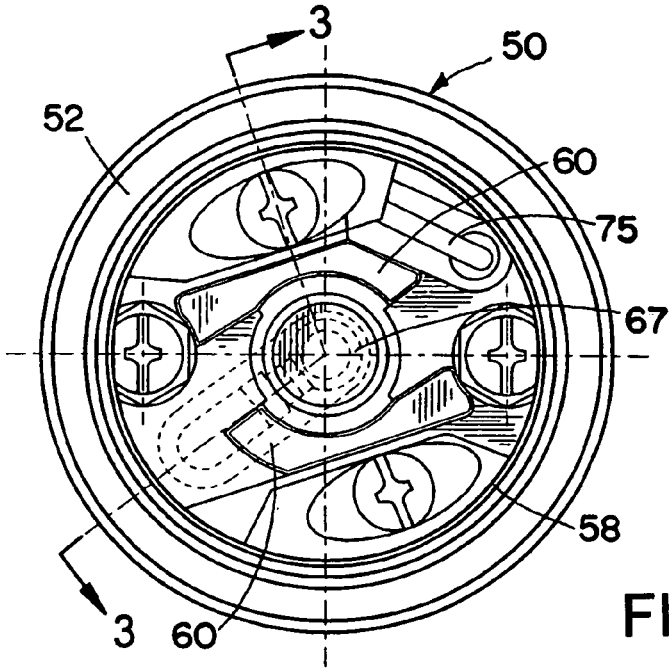
FIG. 2 is a top-view along the lines 2—2 of FIG. 1.

The present invention is directed to a novel lamp holder that will accept and make electrical contact with a lamp having a predetermined base and will accept, but not make electrical contact with lamps having other bases. A cavity (or central well) in the base (or floor) of the lamp socket is provided to accept a lamp configured with an extension extending from the base of the lamp and providing a vertically mounted electrical contact in the cavity that can only be contacted by a lamp contact that is placed at the end of the lamp base extension. A lamp lacking such an extension and a contact on such extension, cannot extend into and engage the contact in the cavity.

Turning now to FIGS. 1–4, a low wattage metal halide lamp 10 and a lamp holder 50 for accepting and providing full electrical connection therewith is shown. Lamp 10 has a glass bulb 12 within which is placed a quartz arc tube (not shown) and a shroud (not shown) of thick quartz positioned about arc tube.

Bulb 12 also includes a conductive screw base 16 with the lower portion containing conductive base threads 18 and an insulating flange 24. Any screw thread pattern may be selected and the particular one shown in the figures is an American Standard mogul thread that is characterized in having four threads per inch.

The base 16 includes an extension 20, which protrudes from the distal end of the lamp 10. The extension 20 generally includes a contact 22 located on a bottom surface of the extension 20, often termed solder or button, also made of metal that is mechanically but not electrically joined to the end of base 16. The base 16 is connected to one side of arc tube while contact 22 is connected to the other. The base 16 may be fabricated from any conductive metal (e.g., copper, a copper alloy, etc.).

The lamp holder 50 has a body 52 of insulating material such as rubber, plastic, porcelain, ceramic or the like. The body 52 of the lamp holder is generally hollowed out to form a cavity or socket 54. Socket 54 contains a conductive sleeve 56, at least a portion of which is secured in the socket 54. The conductive sleeve 56 includes threads 58 formed to complement the base threads 18 of lamp 10. Body 52 includes a central raised hub 60, which optionally may include an aperture (not shown) in its center. A cavity 64 is generally produced at least in part by the hub 60.

The metal contact arm 66 is vertically mounted a center contact 67 arranged to contact the contact 22 of lamp 10. The metal contact arm 66 is generally capable of traversing up or down in the vertical direction. In one embodiment, a cavity 68 is provided to secure the contact arm 66 within the body 52 and to provide an electrical connection to one end of an AC power supply (not shown). In another embodiment, the contact arm 66 is operably sized to fit in a central cavity formed in the body 52 of the lamp holder 10. One of ordinary skill in the art will readily appreciate that there are a variety of ways to operably secure contact arm 66 to the body 52. For example, by an eyelet formed in the base of the contact arm 66 and rivet to secure the contact arm 66 in position.

Figure 3:
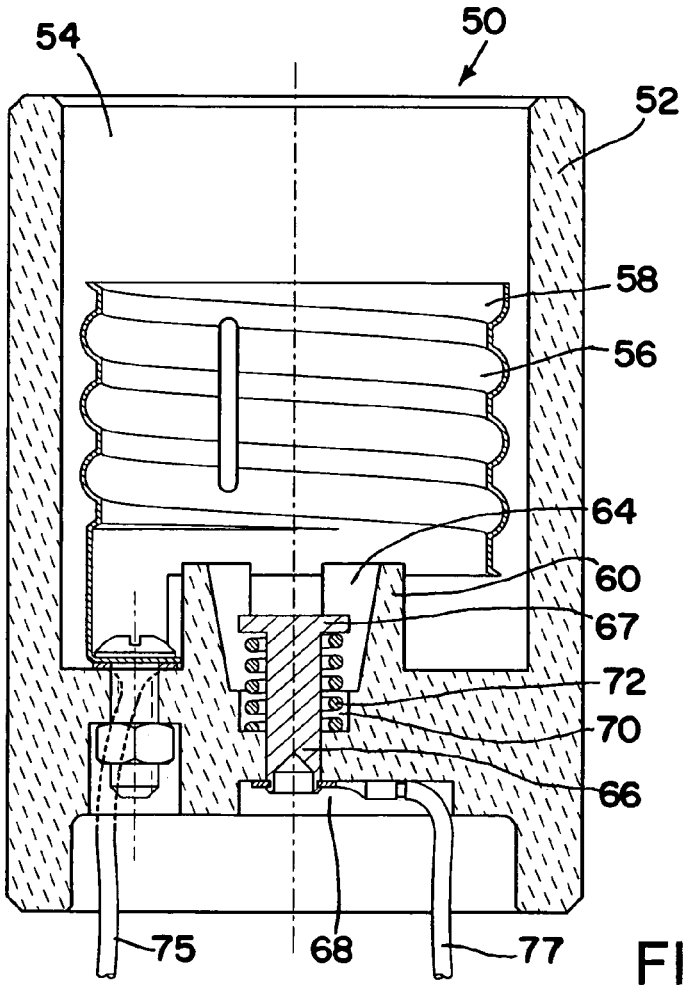
FIG. 3 is a cross-sectional view of a lamp holder along the lines 3—3 of FIG. 2.

Metal contact arm 66 and center contact 67 are electrically insulated from metal sleeve 56. Conductive sleeve 56 is connected to one conductor of an AC supply (not shown) by conductive wire 75 while contact arm 60 is connected to the second of such conductors of the AC supply (not shown) by conductive wire 77 to provide current to operate lamp 10, as shown in FIGS. 3 and 4.

Figure 4:
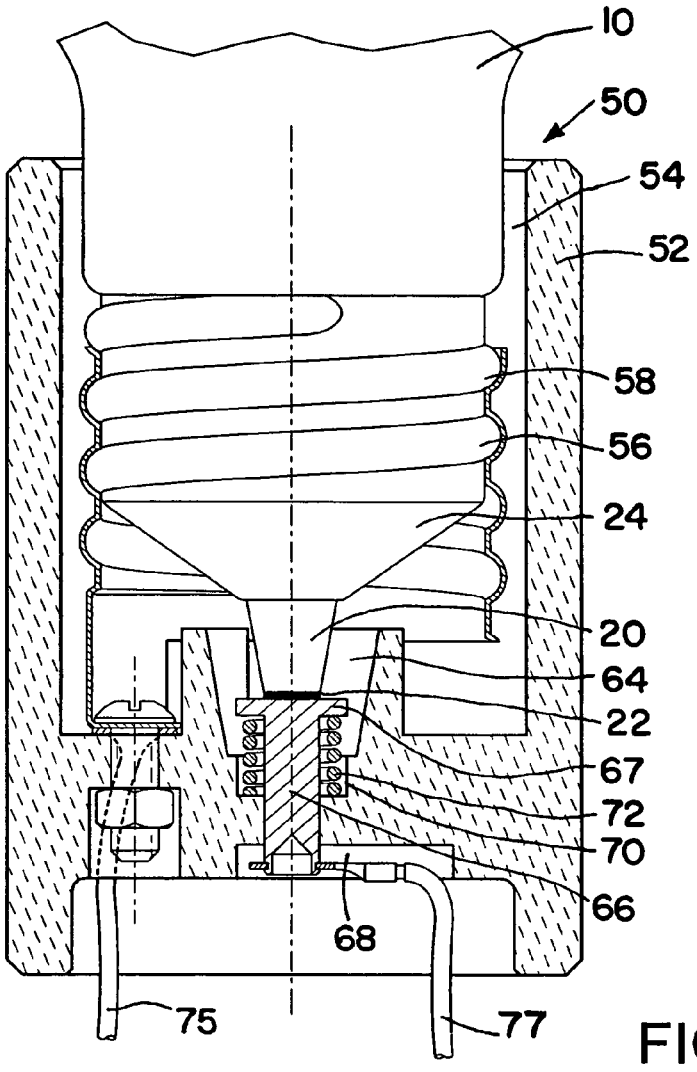
FIG. 4 is a cross-sectional view of a lamp holder along the lines 3—3 of FIG. 2 with an associated lamp engaged in the lamp holder.

FIGS. 1 and 4, illustrate lamp 10 engaged with lamp holder 50. The conductive base threads 18 of the lamp 10 are advanced along conductive socket threads 58 until contact 22 enters cavity 64 and makes solid contact with center contact 67 of metal contact arm 60, allowing current to flow to the lamp 10. A recess 72 in the body 52 is capable of receiving one end of a spring 72 whose other end engages the underside of the center contact 67 of the contact arm 66. As shown in FIGS. 1 and 4, the spring 72 is a compression spring that imparts an upward vertical force on the contact arm 66. The spring 72 urges metal contact arm 66 upwardly against the contact 22 of lamp 10 when lamp 30 is threadably positioned in lamp holder 50.

As shown in FIG. 4, lamp 10 is placed in cavity 54 of lamp holder 50 and base threads 18 are advanced along threads 58 of conductive sleeve 56 by rotating lamp 10 in a clockwise direction. Extension 22 enters the cavity 64 in hub 60 and lamp contact 22 engages center contact 67 of contact arm 66. A secure electrical contact between contact 22 and the center contact of the contact arm 66 is assured by a spring 72 (e.g., a compression spring, finger spring, torsion spring, cantilever spring, etc.) that urges contact arm 66 into contact with contact 22. In one embodiment, an insulating flange 19 may contact the top surface of the hub 60 to limit downward insertion of lamp 10. One of ordinary skill in the art will readily appreciate that spring 72 may take a variety of forms (e.g., a classic spring or a substantially elastic mechanical component that functions as a spring (e.g., a compression washer). All such forms should be considered to fall within the scope of the invention so long as an opposing force is supplied to urge contact between the contact arm 66 and the contact 22.

The vertically mounted contact arm 66 has several advantages over other contact arm arrangements (e.g., cantilever mounted contact arms). For example, a vertically oriented contact arm 66 will not allow for the accidental displacement of the center contact 67 of the contact arm 66 during insertion, removal and/or replacing of lamps in the lamp holder 50. In a cantilever-type design, the center contact spring could be displaced or dislodged if the center contact becomes bent during a re-lamping process.

The vertically oriented contact arm 66 uses a cavity 68 that holds the eyelet/riveted end on the connection side of the lamp holder 50. This cavity provides at least two benefits over cantilever mounted contact arms: 1) to insulate the eyelet from accidental or inadvertent travel of the center contact 67 and the contact arm 66 when a lamp base 16 is secured into the lamp holder 50; and 2) to prevent rotation of center contact 67 as the lamp base 16 is screwed or unscrewed in the event of a mechanical bond being developed between re-lampings. This mechanical bond can be caused by an arc should the lamp not be completely seated after a previous re-lamping.

The vertically oriented contact arm 66 will not allow for the tampering of the center contact 67. The center contact 67 cannot be bent to extend to a point above the lamp security well formed by the hub 60 so that an "enclosed" fixture bulb can be used in a lamp holder designed for an "open" fixture mental halide bulb. The center contact 67 in the present invention is designed as a security measure that cannot be defeated by bending of the center contact 67 and/or contact arm 66, which is possible in a cantilever-type design.

The lamp holder 50 can have the center contact 67 or any surface upon which a lamp may be seated color-coated to become a tamper indicator. A tamper indicator may be seen by a technician during the normal re-lamping process, to confirm if lamp holder 50 has been tampered or the base damaged and now requires replacement. For example, if a color is missing from one or more contact surfaces, the lamp base will indicate that it needs to be replaced because the cavity formed by the hub (e.g., the safety well) has become damaged or broken and maybe compromised so that an "open" metal halide bulb maybe able to function in the socket. One of ordinary skill in the art will readily appreciate that a variety of tamper indicators may be used in accordance with the present invention (e.g., visible indicators, circuit breakers, fuses, etc.).

In the event that one tries to employ a lamp without a suitable extension into lamp holder 50, base threads 18 of lamp 10 engage threads 58 of conductive sleeve 56 and the lamp advances until the lamp insulator comes to rest upon hub 60. The lamp contact extends partially into cavity 64. However, because of the absence of any extension similar to extension 20, the contact 22 is spaced a part a distance above contact arm 66 and no electrical contact is made. Accordingly, the lamp cannot be supplied with the current required to light the lamp. Thus, the lamp holder 50 will only accept and electrically connect lamps 10 having the extension 20 indicative of a lamp intended for "open" fixture use, and will accept but not electrically connect lamps intended for "enclosed" fixtures.

Figure 6:
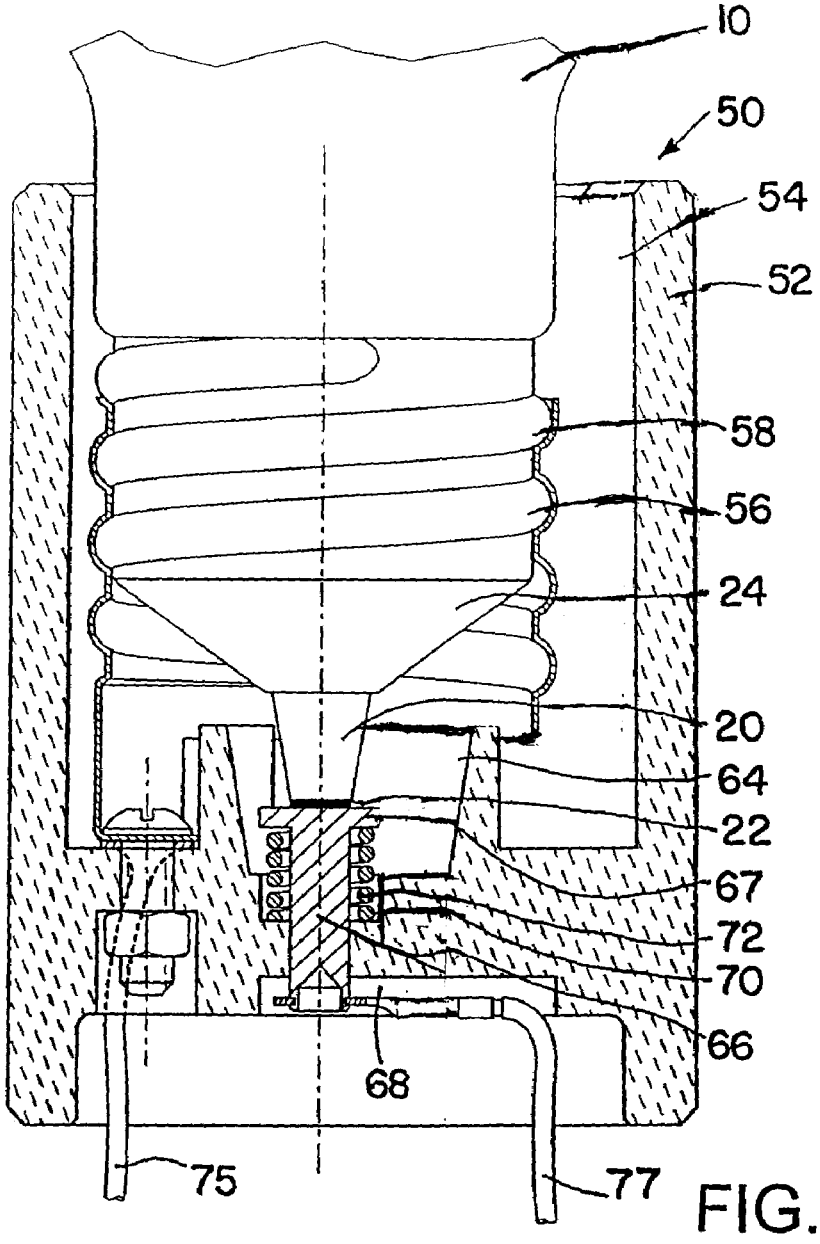
FIG. 6 is a cross-sectional view of an exemplary lamp holder in accordance with one aspect of the present invention.

While the second cavity of the lamp holder may be symmetrical about a center point, as shown in FIGS. 1–4, the second cavity may also be discontinuous about a center point, as shown in FIG. 6. For example, the second cavity may be offset from a central axis of the lamp socket.

Figure 5:
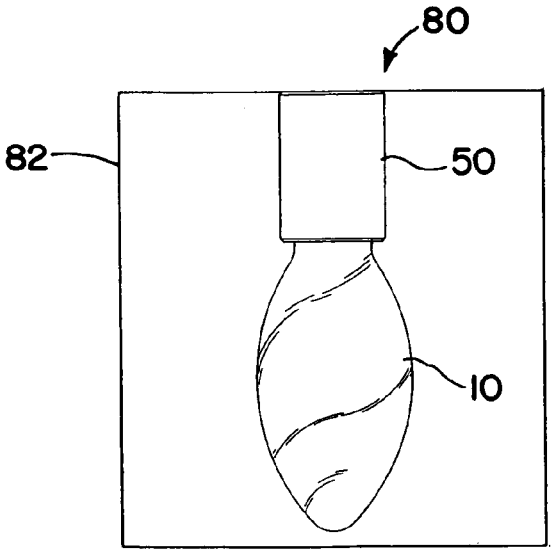
FIG. 5 is a perspective view of lamp fixture in accordance with one aspect of the present invent.

FIG. 5 illustrates a lamp fixture 80 in accordance with the present invention. The lamp fixture 80 includes a lamp holder 50 as discussed above, a lamp 10 and a housing 82. The lamp fixture 80 may be used in any environment. For example, the lamp fixture 60 may be used in the following lighting applications: gymnasiums, factories, warehouses, etc. One of ordinary skill in the art will readily appreciate that lamp fixtures in accordance with the present invention may take any form and shape. In addition, the lamp fixture in accordance with the present invention may be used in any lighting application.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A lamp holder comprising:

a lamp socket body of insulating material having an open first end, a closed second end and a sidewall, wherein the open first end, the closed second end and the sidewall form a first cavity;

a conductive sleeve disposed within at least a portion of the first cavity, wherein the conductive sleeve includes a top portion, a central portion and a bottom portion, wherein at least one portion of the conductive sleeve is at least partially threaded for receiving an associated lamp having an extension and a central button contact secured to a distal end of the extension, and the conductive sleeve is adapted to be connected to one side of an AC voltage supply;

a second cavity formed by a stationary hub in the lamp socket body adjacent the closed second end and communicating with said first cavity to solely receive at least a portion of the extension and the central button contact of the associated lamp;

a vertically mounted contact, the contact having a first end and a second, free end extending substantially vertically from the first end and into the second cavity to engage the central button contact of the associated lamp, wherein the contact is adapted to be connected to a second side of the AC voltage supply;

a recess in the interior of the second closed end communicating with the second cavity; and a spring having a first end and a second end, the first end in the recess and the second end engaging the second, free end of the contact to urge the contact second end into intimate contact with the central button contact of the associated lamp in the second cavity.

2. The lamp holder of claim 1, wherein the conductive sleeve is made of a metal.

3. The lamp holder of claim 1, wherein the conductive sleeve is removably secured to the lamp socket body.

4. The lamp holder of claim 1, wherein the insulating material is selected from a group consisting of: porcelain, plastic, and rubber.

5. The lamp holder of claim 1, wherein the second cavity is symmetrical about a center point.

6. The lamp holder of claim 1, wherein the second cavity is offset from a central axis of the lamp socket.

7. The lamp holder of claim 1, wherein the spring is a compression spring.

8. The lamp holder of claim 7, wherein the spring is secured against the body and a conductive contact arm.

9. The lamp holder of claim 8, wherein the conductive contact arm engages the vertically mounted contact with the associated lamp.

10. The lamp holder of claim 1, wherein the spring is selected from a group consisting of a cantilever spring, torsion spring, or a compression washer.

11. A light fixture comprising:

the lamp holder according to claim 1; and a housing to which the lamp holder is secured.

12. A lamp holder comprising:

a lamp socket body of insulating material having an open first end, a closed second end and a sidewall, wherein the open first end, the closed second end and the sidewall form a first cavity;

a conductive sleeve disposed within at least a portion of the first cavity, wherein the conductive sleeve includes a top portion, a central portion and a bottom portion, wherein at least one portion of the conductive sleeve is at least partially threaded for receiving an associated lamp having an extension and a central button contact secured to a distal end of the extension, and the conductive sleeve is adapted to be connected to one side of an AC voltage supply;

a second cavity formed by a stationary hub in the lamp socket body adjacent the closed second end and communicating with the first cavity to solely receive at least a portion of the extension and the central button contact of the associated lamp;

a vertically mounted contact, the contact having a first end formed in the lamp socket body and a second, free end extending substantially vertically from the first end and into the second cavity to engage the central button contact of the associated lamp, wherein the contact is adapted to be connected to a second side of the AC voltage supply;

a recess in the interior of the second closed end communicating with the second cavity; and a spring having a first end and a second end, the first end in the recess and the second end engaging the second, free end of the contact to urge the contact second end into intimate contact with the central button contact of the associated lamp in the second cavity.

13. A light fixture comprising:

the lamp holder according to claim 12; and a housing to which the lamp holder is secured.

* * * * *